US009051838B2

(12) United States Patent
Wardle et al.

(10) Patent No.: US 9,051,838 B2
(45) Date of Patent: Jun. 9, 2015

(54) TURBINE BLADE

(75) Inventors: Brian Kenneth Wardle, Brugg-Lauffohr (CH); Christoph Didion, Wettingen (CH); Herbert Brandl, Waldshut-Tiengen (DE); Shailendra Naik, Gebenstorf (CH)

(73) Assignee: ALSTOM TECHNOLOGY LTD., Baden (CH)

( * ) Notice: Subject to any disclaimer, the term of this patent is extended or adjusted under 35 U.S.C. 154(b) by 627 days.

(21) Appl. No.: 13/330,919

(22) Filed: Dec. 20, 2011

(65) Prior Publication Data

US 2012/0163995 A1 Jun. 28, 2012

(30) Foreign Application Priority Data

Dec. 27, 2010 (CH) ..... 2179/10

(51) Int. Cl.
*F01D 5/08* (2006.01)
*F01D 5/18* (2006.01)

(52) U.S. Cl.
CPC ..... *F01D 5/081* (2013.01); *Y10T 29/49341* (2013.01); *F01D 5/087* (2013.01); *F01D 5/188* (2013.01)

(58) Field of Classification Search
CPC ..... F01D 5/081; F01D 5/082; F01D 5/188; F01D 5/02; F01D 5/08; F01D 5/3007; F01D 5/087
USPC ..... 415/115; 416/95, 96 A, 96 R, 97 R, 97 A, 416/181, 231 R; 29/889.7, 527.2, 557
See application file for complete search history.

(56) References Cited

U.S. PATENT DOCUMENTS 2,819,870 A * 1/1958 Wayne ..... 416/248
3,706,508 A * 12/1972 Moskowitz et al. ..... 415/115
3,982,851 A * 9/1976 Andersen et al. ..... 416/92
4,047,837 A * 9/1977 Hueber et al. ..... 416/95
4,073,599 A * 2/1978 Allen et al. ..... 416/97 R (Continued)

FOREIGN PATENT DOCUMENTS

DE 202011109225 U1 * 4/2012
EP 0670953 9/1995

(Continued)

OTHER PUBLICATIONS

Search Report for Swiss Patent App. No. 2179/2010 (Jan. 14, 2011).

*Primary Examiner* — Edward Look
*Assistant Examiner* — Christopher R Legendre
(74) *Attorney, Agent, or Firm* — Buchanan Ingersoll & Rooney PC

(57) ABSTRACT

A turbine blade of an axial turbine includes internal cooling fluid passages with radially outwardly extending passages connected to holes in the blade root. The holes are generally core printouts providing stability to the core during the casting process, but are not needed and need to be closed to guarantee the functioning of the cooling system. This is achieved by at least one covering plate. The plate is held by at least two slots located at the root of the turbine blade. Thus, the supply holes for cooling fluid located at the root section are closed by a simple mechanical device, e.g., a plate that does not require any subsequent brazing/welding operations. In addition, the plate is removable to facilitate inspection/cleaning, or further processing of the blade at service intervals.

6 Claims, 3 Drawing Sheets

(56) References Cited

U.S. PATENT DOCUMENTS

| | | | | |
|---|---|---|---|---|
| 4,236,870 | A * | 12/1980 | Hucul et al. | 416/97 R |
| 4,589,824 | A | 5/1986 | Kozlin | |
| 4,820,123 | A * | 4/1989 | Hall | 416/97 R |
| 4,898,514 | A * | 2/1990 | McCracken | 416/95 |
| 5,125,794 | A * | 6/1992 | Detanne | 415/115 |
| 5,941,687 | A * | 8/1999 | Tubbs | 416/97 R |
| 6,059,529 | A * | 5/2000 | Schiavo | 416/96 R |
| 6,416,275 | B1 * | 7/2002 | Itzel et al. | 415/116 |
| 6,485,255 | B1 * | 11/2002 | Care et al. | 415/12 |
| 6,634,858 | B2 * | 10/2003 | Roeloffs et al. | 416/97 R |
| 6,974,306 | B2 * | 12/2005 | Djeridane et al. | 416/1 |
| 6,981,845 | B2 * | 1/2006 | Balland et al. | 416/96 R |
| 7,198,463 | B2 * | 4/2007 | Kanebako et al. | 415/175 |
| 7,270,517 | B2 * | 9/2007 | Garner | 416/145 |
| 7,524,168 | B2 * | 4/2009 | Tschuor et al. | 416/97 R |
| 8,016,547 | B2 * | 9/2011 | Propheter-Hinckley | 415/115 |
| 8,113,784 | B2 * | 2/2012 | Gupta | 416/193 A |
| 8,628,300 | B2 * | 1/2014 | Boyer | 416/97 R |
| 2004/0022629 | A1 * | 2/2004 | Tiemann | 416/96 R |
| 2007/0212228 | A1 * | 9/2007 | Digard Brou De Cuissart et al. | 416/97 R |
| 2009/0185893 | A1 * | 7/2009 | Propheter-Hinckley | 415/1 |
| 2011/0194944 | A1 * | 8/2011 | Grohens et al. | 416/97 R |
| 2012/0082568 | A1 * | 4/2012 | Tibbott et al. | 416/97 R |
| 2012/0163995 | A1 * | 6/2012 | Wardle et al. | 416/97 R |
| 2012/0321461 | A1 * | 12/2012 | Coutandin et al. | 416/1 |

FOREIGN PATENT DOCUMENTS

| | | |
|---|---|---|
| EP | 0854005 | 7/1998 |
| EP | 1267040 | 12/2002 |
| FR | 2937372 | 4/2010 |
| JP | 2002303101 A * | 10/2002 |
| WO | WO2005/095761 | 10/2005 |

* cited by examiner

TURBINE BLADE

This application claims priority under 35 U.S.C. §119 to Swiss App. No. 02179/10, filed 27 Dec. 2010, the entirety of which is incorporated by reference herein.

BACKGROUND

1. Field of Endeavor

This invention relates to a turbine blade, and further relates to a process for producing a turbine blade.

2. Brief Description of the Related Art

Turbine blades are subjected to very high temperatures of the hot fluid driving the turbine. In order to prevent damage to the blades due to the high temperatures and in order to assure a reasonable lifetime of the turbine, turbine blades are often cooled externally and internally by a cooling medium, typically by using cooling air bled from the compressor of the gas turbine. Internal cooling of the turbine blade is realized by several passages within the blade between the pressure sidewall and the suction sidewall of the turbine blade. The passages typically extend spanwise from the root of the blade to its tip. Some of the passages are formed of a single passage with an exit port near the tip of the blade and/or several film cooling holes on the edge or on the side wall of the blade. Other passages may follow a serpentine path allowing the cooling fluid to flow for example from the root to the tip and around a 180° turn. From the tip it extends towards the root and around a further 180° turn that directs it again toward the tip where it finally exits through exit ports or film cooling holes. Serpentine cooling passages of this type are disclosed, for example, in EP 670953. They allow for a high internal heat transfer with a minimum amount of cooling air.

A typical blade of the state of the art includes several internal passages extending radially inward and outward between a root section and a tip. A first internal passage extends from an entry opening in the root section radially outward to the tip of the blade. Cooling fluid can flow from the root section through the passage and exit via several cooling slots along the trailing edge as well as through a tip hole. A second internal passage extends from an entry opening radially outward along the leading edge of the blade. Cooling fluid flows through this passage and exits via a tip hole and through several rows of film cooling holes drilled through the leading edge of the blade. A serpentine passage includes an entry opening at the radially inner end of the root section, a first passage extending radially outward with a tip hole. At the tip a 180° turn leads to a passage extending radially inward. At the radially inner end of the passage a second 180° turn leads to a third passage extending radially outward to a tip hole. Cooling fluid flowing through the straight and serpentine passages cool the blade from within by impingement cooling and exits through the film cooling holes on the edges of the blade and/or through the tip holes. Other typical blades have several serpentine cooling passages or serpentine passages including five passages with four turns.

Blades with internal serpentine geometry for the cooling passages are typically manufactured by an investment casting process, which utilizes a ceramic core to define the individual internal passages. Following the casting the ceramic core is removed from the blade by a leaching process. The film cooling holes on the edges and sidewalls of the blade are then realized by a laser drilling process. This process involves, prior to the actual drilling, the insertion of a backing or blocking material which limits the laser radiation to the desired locations of the film cooling holes and prevents damage to the passage walls and other inner surfaces of the blade.

Such a method is disclosed, for example, in EP 854005. It uses a wax material as a blocking material.

Another suitable drilling process could be an ion beam drilling process.

During the process of casting the internal passages it is often difficult to maintain the separation of the passages in the cores due to thermal strains caused by differential heating and cooling rates of the core and surrounding metal.

A current practice to maintain the separation of the serpentine passages and to support the core during the casting process utilizes conically shaped features in the core. These conical features are formed as part of the core and extend from the root section through an opening in the wall of the 180° turn and into the passages. After the part is cast and the core is leached out, the conical feature is closed off with a spherically shaped plug that is brazed into place, as described in EP 1267040.

Finally, a TBC (Thermal Barrier Coating) coating is applied to the turbine blade. This coating serves to insulate components from large and prolonged heat loads by utilizing materials with lower thermal conductivity which can sustain an appreciable temperature difference between the load bearing alloys and the coating surface. The thermal insulation system coatings often are formed of three layers: the metal substrate, metallic bond coat, and TBC ceramic topcoat. The ceramic topcoat is typically composed of yttria-stabilized zirconia (YSZ) which is desirable for having very low conductivity while remaining stable at nominal operating temperatures. This ceramic layer creates the largest thermal gradient of the thermal insulation system and keeps the lower layers at a lower temperature than the surface. Once applied to the turbine blade, subsequent welding and/or brazing is not feasible in an economical way.

EP 1267040 discloses an airfoil having internal cooling air passages arranged in a serpentine manner with one or more radially outward and radially inward extending passages. The passages are in fluid connection by turns of approximately 180°. According to that document, the turns near the platform of the airfoil connecting a radially inward extending passage with a radially outward extending passage is realized by a root turn defined by the passage sidewalls, which extend radially inward to the radially inner end of the root section of the airfoil, and by an end plate attached to the radially inner ends of the walls. The end plate is welded or brazed to the radially inner ends of the sidewalls of the serpentine passages combined by the root turn.

SUMMARY

One of numerous aspects of the present invention includes a turbine blade and a method to manufacture the same having at least one of the supply holes for cooling fluid located at the root section being closed by a plate that does not require any subsequent brazing/welding operations, which may be detrimental to the mechanical properties of the blade and/or plate. The plate is removable to facilitate inspection/cleaning, or further processing of the blade at service intervals. Further, this aspect is applicable to new or existing design of blades, i.e., for new products and refitted blades.

Another aspect includes a turbine blade of an axial turbine comprising internal passages, e.g., cooling fluid passages, with radially outwardly extending passages connected to holes in the blade root, wherein at least one of the supply holes is covered by a plate. The plate is held in a slot located at the root of the turbine blade. The radially outwardly extending passages with holes are generally core printouts providing stability to the core during the casting process. Often not all of these core printouts are needed later on for cooling air supply. These not-needed holes need to be closed to guarantee the functioning of the cooling system. The so called "letter box slot" for holding the plate can be electro discharge machined (EDM) transversely through the lower part of the root section of the turbine blade and may for example be arranged to allow the plate to be moved over the hole to be closed by simply sliding it into the slot. Thus the plate can be placed removeably over the hole to be covered by a form-locked joint. Thereby the slot can be easily manufactured as a through-going slot, i.e., may be open on both sides of the turbine blade root. Thus, the hole for cooling fluid located at the root section is closed by a simple mechanical device, i.e., a plate that does not require any subsequent brazing/welding operations. In addition, the plate is removable to facilitate inspection/cleaning, or further processing of the blade at service intervals. Further, the subject matter described herein is applicable to new or existing designs of blades, i.e., for new products and refitted blades. The subject matter described herein can be used with all turbine blades that require closure of a hole, e.g., a core printout or a core profile exit in the root section.

An advantageous embodiment of the turbine blade is characterized by the fact that the slots are machined in a thickened portion of the root area. That is, there is material added to the lower part of the root of the turbine blade. After the material has been added, the slot is machined into the added material to accommodate the plate. This is advantageous because the load bearing flanks of the root of the turbine blade are not affected by the slots and stress concentration caused by the machining of the slots is avoided. The covering plate can then be slideably introduced in the slot to sealingly cover the respective hole. If necessary, this plate can be removed by simply sliding it back. Thus, maintenance work of the root of the turbine blade and the cooling passages can be easily conducted.

Another advantageous embodiment of the turbine blade is characterized by the fact that the plate is removably secured by the flanks of the rotor of the axial turbine. This is an easy, fail-safe and cost effective way for securing the plate against movement. A typical application could be, for example, the low pressure turbine stage of a gas turbine, particularly a stationary gas turbine.

Another advantageous embodiment of the turbine blade is characterized by the fact that the plate comprises an orifice hole. While the plate may be generally used as a closure, it may as well be used as a metering plate with metering orifice. Thus, the plate can fulfill a double function.

Still another advantageous embodiment of the turbine blade is characterized by the fact that the blade has a fir tree root section. Once the turbine blade is mounted on the turbine disk by inserting the fir tree root in the respective receiving sections, the plate is locked and cannot move out.

An advantageous embodiment of the turbine blade is characterized by the fact that the slot is furnished as a blind slot, i.e., the slot is not through-going. In any event, the slot needs to be long enough that the plate will cover the entire supply hole. It is one benefit of the part through or blind slot arrangement that only one end of the plate needs to be secured against movement. This way only little machining, preferably EDM (electro discharge machining) is needed to adapt existing blades to the plate solution described herein.

An advantageous embodiment of the turbine blade is characterized by the fact that the plate is made from a heat resisting alloy manufactured from a sheet material. Such an alloy may be, for example, Hastaloy X or a similar material.

A process for producing a turbine blade of an axial turbine comprising internal passages with radially outwardly extending passages, connected to holes in the blade root, wherein at least one of the holes is covered by a plate, comprising the following steps: machining a slot for holding a plate sealingly in the root area of the turbine blade; and inserting the plate slideably in the slot, thus covering the respective hole to be closed by a form-locked joint.

Further, before machining of the slot, additional stock is added to the root area to locate the slot outside the load bearing flanks of the root of the turbine blade. This step is an alternative embodiment used instead of machining the slot directly in the root of the turbine blade.

This process can be very advantageous if used for refitting existing turbine blades, since the material structure of the existing blade is not affected by the assembly of the plate.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
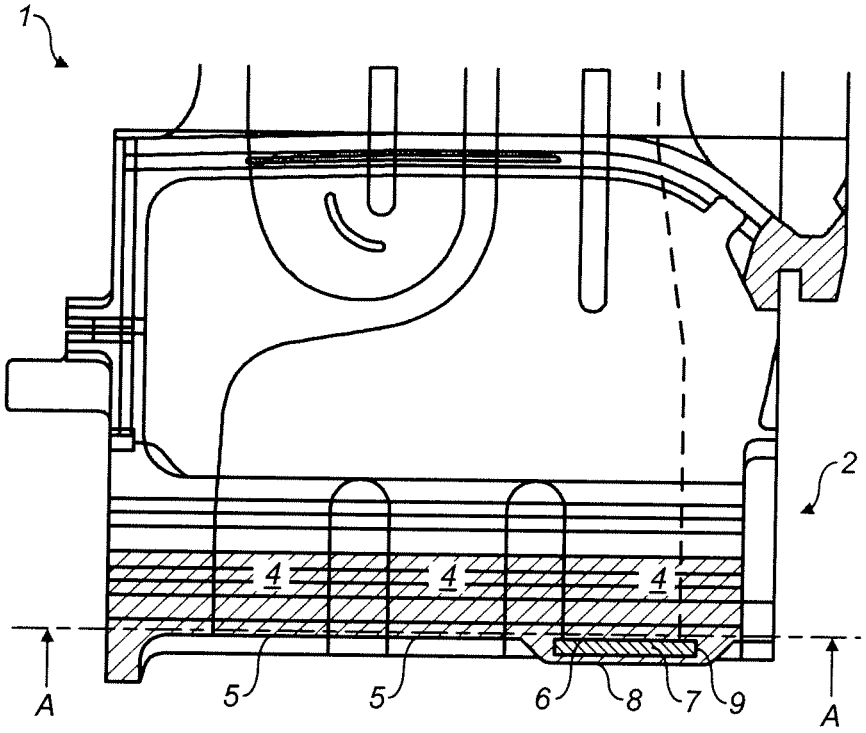
FIG. 1 shows a partial spanwise cross-section of a turbine blade having a plate cover in the root section according to a first inventive embodiment.

Referring now to the drawings, wherein like reference numerals designate identical or corresponding parts throughout the several views. The drawings are for explanatory purposes only.

Figure 2:
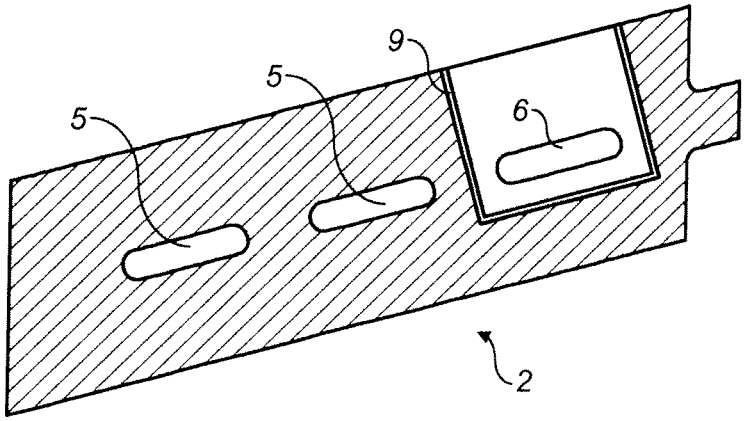
FIG. 2 shows a cross sectional view along line A-A of the turbine blade of FIG. 1.

FIG. 1 shows partial spanwise cross-section of a turbine blade 1 of a gas turbine according to principles of the present invention. It extends from the root section 2 to the tip (not shown) and includes several internal passages 4. Further, FIG. 2 shows a cross sectional view of the turbine blade 1 along line A-A of FIG. 1. A passage 4 extends from the supply hole 5 for cooling air at the root 2 radially outward to the tip. Cooling air can exit through cooling slots (not shown). The hole 6 at the root 2 is closed off by a cover plate 7, which is removably secured to the root 2 of the turbine blade 1 by insertion into a slot 9 machined into added material at the root 2 of the blade 1. The slot 9 is furnished as a blind slot 9, as can be seen from FIG. 2, where the area of the blind slot 9 is shown without the plate 7, thus allowing to see the hole 6 to be covered by the plate 7.

Figure 3:
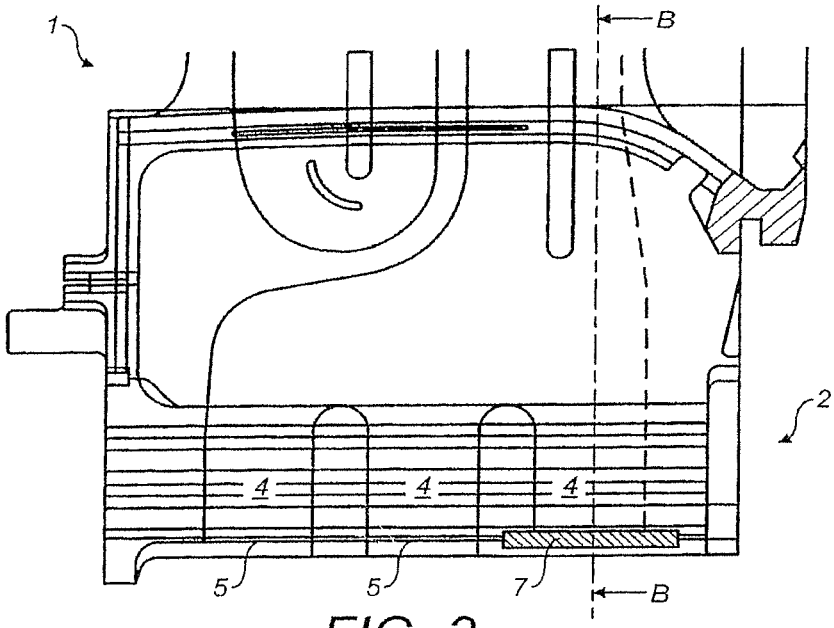
FIG. 3 shows a partial spanwise cross-section of a turbine blade having a plate cover in the root section according to a second embodiment of the invention.
Figure 4:
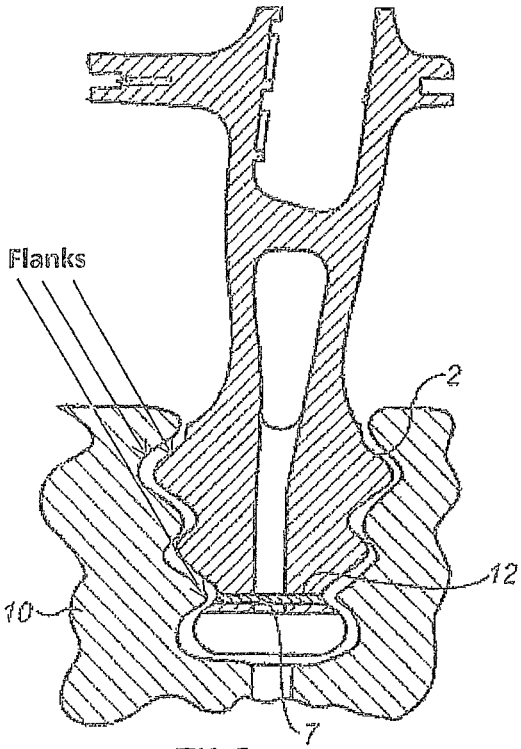
FIG. 4 shows a partial front cross-section of the turbine blade of FIG. 3, inserted in the turbine rotor.

FIG. 3 shows a partial spanwise cross-sectional view of a turbine blade 1 having a plate cover 7 in the root section 2 according to a second exemplary embodiment of the invention. FIG. 4 shows a partial front cross-section of the turbine blade 1 along the line B-B of FIG. 3. Contrary to the first embodiment, the second embodiment shows a slot 12 which is directly machined in the fir tree root section 2 of the turbine blade 1 without additional material added. Further, contrary to the first embodiment, the slot 9 holding the plate 7 is a through going slot, as can be best seen in FIG. 4. The fir tree root section 2 is inserted in the receiving rotor groove of the turbine rotor 10. This arrangement is effectively blocking the plate 7 from moving out of the slot 12. No additional securing of the plate 7 is needed in such a case.

Figure 5:
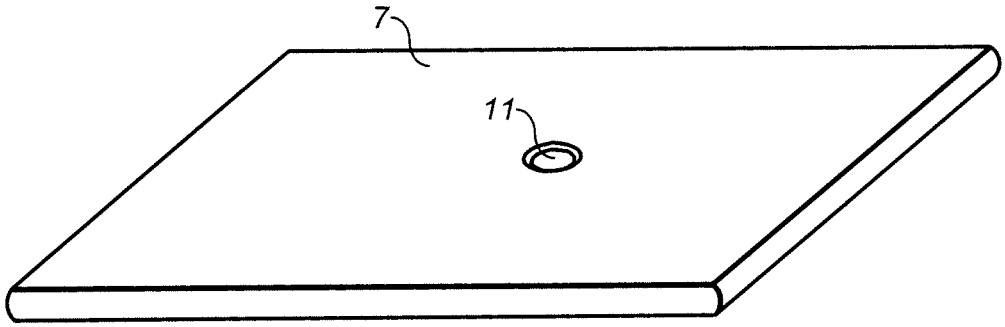
FIG. 5 shows a plate having an orifice hole.

Finally, FIG. 5 shows a perspective view of a plate 7 according to one preferred embodiment having an orifice hole 11. This way the plate 7 can be used as a metering plate. The plate 7 has generally a rectangular shape and rounded edges, to be easily movable within the slot 9. Also, removing the plate 7 for maintenance work can be easily achieved. In the present embodiments, the plate 7 is made of a Hastaloy X metal sheet and has a thickness of around 0.1 mm to 5 mm, particularly around 1 mm.

Numerous modifications and variations of the present invention are possible in light of the above teachings. It is therefore to be understood that, within the scope of the appended claims, the invention may be practiced otherwise than as specifically described herein.

REFERENCE SIGNS

1 turbine blade
2 root section
4 internal passage
5 supply hole
6 hole
7 plate
8 added material
9 blind slot
10 turbine rotor
11 orifice hole
12 through going slot While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A turbine blade of an axial turbine, the blade comprising:
a blade root having a slot and holes therein;
a blade body having internal passages with radially outwardly extending passages connected to the blade root holes; and
a plate covering at least one of the blade root holes, the plate being held in the blade root slot and being slideably moveable in and removeable from the slot, wherein the slot is a through-going slot having a respective opening on each of two opposed sides of the turbine blade root.

2. The turbine blade of an axial turbine according to claim 1, wherein the slot is machined in a thickened portion of the root area.

3. The turbine blade of an axial turbine according to claim 1, wherein the plate comprises an orifice hole.

4. The turbine blade of an axial turbine according to claim 1, wherein the blade root has a fir tree root section.

5. The turbine blade of an axial turbine according to claim 1, wherein the plate is made from a heat resisting alloy manufactured from a sheet material.

6. An axial turbine, comprising:
the turbine blade according to claim 1, and a turbine rotor having flanks, wherein the plate is removably secured by the turbine rotor flanks.

* * * * *